US011413625B2

(12) United States Patent
Schwaiger et al.

(10) Patent No.: US 11,413,625 B2
(45) Date of Patent: Aug. 16, 2022

(54) MAGNETIC ISOLATING APPARATUS WITH NON-PHYSICAL COUPLING BETWEEN A MAGNET ARRANGEMENT AND THE MOVEMENT DRIVE OF SAID MAGNET ARRANGEMENT

(71) Applicant: Hamilton Bonaduz AG, Bonaduz (CH)

(72) Inventors: Ingo Schwaiger, Chur (CH); Hanspeter Romer, Hinwil (CH)

(73) Assignee: Hamilton Bonaduz AG, Bonaduz (CH)

( * ) Notice: Subject to any disclaimer, the term of this patent is extended or adjusted under 35 U.S.C. 154(b) by 471 days.

(21) Appl. No.: 16/338,187

(22) PCT Filed: Sep. 25, 2017

(86) PCT No.: PCT/EP2017/074228

§ 371 (c)(1),
(2) Date: Dec. 18, 2019

(87) PCT Pub. No.: WO2018/060137

PCT Pub. Date: Apr. 5, 2018

(65) Prior Publication Data

US 2020/0139379 A1 May 7, 2020

(30) Foreign Application Priority Data

Sep. 30, 2016 (DE) ..... 10 2016 219 053.9

(51) Int. Cl.
*B03C 1/30* (2006.01)
*B03C 1/01* (2006.01)
(Continued)

(52) U.S. Cl.
CPC ..... *B03C 1/01* (2013.01); *B03C 1/0332* (2013.01); *B03C 1/284* (2013.01); *B03C 1/286* (2013.01);
(Continued)

(58) Field of Classification Search
CPC .. B03C 1/28; B03C 1/01; B03C 1/033; B03C 1/0332; B03C 1/30; B03C 1/284; B03C 1/286; B03C 2201/26; B03C 2201/18
See application file for complete search history.

(56) References Cited

U.S. PATENT DOCUMENTS 3,985,649 A 10/1976 Eddelmann
5,647,994 A * 7/1997 Tuunanen ..... B03C 1/288 210/695
(Continued)

FOREIGN PATENT DOCUMENTS

CN 1136452 C 1/2004
CN 102892507 A 1/2013
(Continued)

OTHER PUBLICATIONS

Chinese Office Action Issued in CN 201780060197.X dated Mar. 12, 2020.
(Continued)

*Primary Examiner* — Michael McCullough
*Assistant Examiner* — Molly K Devine
(74) *Attorney, Agent, or Firm* — Tollefson IP

(57) ABSTRACT

A magnetic isolating apparatus (10) for isolating magnetic particles (66) from a suspension has an immersion section (30) which is designed to be temporarily immersed in the suspension, a guide apparatus (16) which extends along a guide path (F), a magnet arrangement (18) which is guided by the guide apparatus (16) such that it can be moved between an active position which is situated close to the immersion section (30) and an inactive position which is positioned further away from the immersion section (30) along the guide path (F), so that a magnetic field in the region of the immersion section (30) can be changed by moving the magnet arrangement (18) between the active position and the inactive position, and a drive apparatus (22,
(Continued)

50) by which the magnet arrangement (18) can be driven to move at least in a direction between the active position and the inactive position, wherein the drive apparatus (22, 50) is coupled in a non-physical manner to the magnet arrangement (18) by a force field and/or a fluid so as to transmit drive force.

19 Claims, 9 Drawing Sheets

(51) Int. Cl.
*B03C 1/033* (2006.01)
*B03C 1/28* (2006.01)

(52) U.S. Cl.
CPC ..... *B03C 2201/18* (2013.01); *B03C 2201/26* (2013.01)

(56) References Cited

U.S. PATENT DOCUMENTS

| | | | | |
|---|---|---|---|---|
| 6,409,925 | B1 | 6/2002 | Gombinsky et al. | |
| 6,409,952 | B1 | 6/2002 | Hacker et al. | |
| 6,468,810 | B1 | 10/2002 | Korpela | |
| 6,649,419 | B1 | 11/2003 | Anderson et al. | |
| 7,597,520 | B2 * | 10/2009 | Zobel | G01N 35/04 210/695 |
| 7,799,281 | B2 | 9/2010 | Cook et al. | |
| 2006/0118494 | A1 * | 6/2006 | Rundt | B03C 1/286 210/695 |
| 2006/0269385 | A1 * | 11/2006 | Zobel | B03C 1/30 414/403 |
| 2011/0205835 | A1 | 8/2011 | Zwirner | |
| 2013/0001242 | A1 | 1/2013 | Hofstetter et al. | |

FOREIGN PATENT DOCUMENTS

| | | | |
|---|---|---|---|
| CN | 103391815 | A | 11/2013 |
| DE | 102015218010 | | 3/2017 |
| EP | 1 548 441 | | 6/2005 |
| EP | 1185372 | B1 | 9/2006 |
| EP | 1726963 | A2 | 11/2006 |
| EP | 1560655 | B1 | 9/2011 |
| WO | 02044327 | | 6/2002 |
| WO | 2011083125 | | 7/2011 |
| WO | 2017046234 | | 3/2017 |

OTHER PUBLICATIONS

International Search Report Issued in PCT/EP2017/074228 dated Apr. 4, 2018.
German Search Report Issued in DE 10 2016 219 053.9 dated Jul. 5, 2017.

* cited by examiner

MAGNETIC ISOLATING APPARATUS WITH NON-PHYSICAL COUPLING BETWEEN A MAGNET ARRANGEMENT AND THE MOVEMENT DRIVE OF SAID MAGNET ARRANGEMENT

CROSS-REFERENCE TO RELATED APPLICATIONS

This application is the National Stage of International Application No. PCT/EP2017/074228, filed on Sep. 25, 2017, which claims the benefit of German Application No. 10 2016 219 053.9, filed on Sep. 30, 2016. The contents of both applications are hereby incorporated by reference in their entirety.

The present invention relates to a magnetic isolating apparatus for isolating magnetic particles from a suspension, the isolating apparatus comprising:

- an immersion portion that is embodied for temporary immersion into the suspension;
- a guidance apparatus extending along a guidance path;
- a magnet arrangement that is guided by the guidance apparatus shiftably between an active position located closer to the immersion portion and an inactive position located along the guidance path farther from the immersion portion, so that a magnetic field in the region of the immersion portion is modifiable by shifting the magnet arrangement between the active position and the inactive position; and
- a drive apparatus by means of which the magnet arrangement is drivable to move at least in a direction between the active position and the inactive position.

A magnetic isolating apparatus of the species is known from US 2011/0205835 A1. A further magnetic isolating apparatus having all the features of the preamble of Claim 1 is known from US 2006/0118494 A1.

Isolating apparatuses of this kind are used, for example in chemical, biochemical, and/or pharmaceutical laboratories, to remove from a suspension magnetic particles contained in the suspension.

Such suspensions having magnetic particles can be used, for example, to purify DNA. The magnetic particles serve in this context merely as transport means, and are usually coated in such a way that only a specific constituent of the suspension can be and becomes deposited onto the outer surface, facing away from the particle, of the coating, and can then be removed from the suspension together with the particle. The magnetic particles are thus, as a rule, magnetic only for the purpose of planned removal of chemical or biological material from the suspension liquid.

The term "magnetic" refers to a material that is either magnetizable or magnetized. In most of the applications of the magnetic isolating apparatus discussed here, the magnetic particles encompass or are made of ferromagnetic material.

A further magnetic isolating apparatus is known from U.S. Pat. No. 7,799,281 B2. This document discloses a magnetic isolating apparatus having a soft-magnetic tip that is rigidly coupled, at its longitudinal end located remotely from the immersion portion, to a guidance tube of the guidance apparatus. In the guidance tube, a permanent magnet constituting a magnet arrangement can be brought closer to the soft-magnetic tip until direct contact occurs, and moved away from it.

The movable permanent magnet is polarized along the guidance path, so that one of its magnetic poles can be brought into direct contact with the soft-magnetic tip. The soft-magnetic tip is magnetized for the duration of the direct contact, while it is substantially unmagnetized when the permanent magnet is located at a distance from the soft-magnetic tip. This known magnetic isolating apparatus therefore has no electrically energized components in the region of its soft-magnetic tip, in particular has no electromagnets, which often represent an undesired heat source in magnetic isolating apparatuses.

The guidance path, which coincides with the axis of the guidance tube, is collinear with the tip axis in order to furnish an isolating apparatus that is radially as slender as possible with respect to the tip axis.

U.S. Pat. No. 5,647,994 A discloses a magnetic isolating apparatus in which an annular permanent-magnet arrangement radially externally surrounds a pipetting tip and is manually shiftable by a mechanical linkage in a longitudinal direction of the pipetting tip in order to act upon different zones of the pipetting tip with its magnetic field.

The magnet arrangements of all the aforementioned documents of the existing art comprise a permanent magnet. The magnet arrangements are coupled to their respective drive apparatus via a rod received in the guidance tube and extending coaxially with the guidance tube or, in the case of U.S. Pat. No. 7,799,281 B2, alternatively via a cable received in the guidance tube and proceeding coaxially with the guidance tube, and are thus drivable to move within the guidance tube. The isolating apparatuses are therefore demanding at least in terms of installation space along the guidance path. Their magnet arrangements, together with the coupling to the respective motion drive (if in fact present), furthermore have a comparatively large moving mass, which means that the magnet arrangements move sluggishly.

The underlying object of the present Application is therefore to refine the magnetic isolating apparatus of the species in such a way that, without requiring excessive installation space, it enables rapid shifting of the magnet arrangement between the active position and the inactive position.

This object is achieved according to the present invention by a magnetic isolating apparatus of the species whose drive apparatus is non-physically drive-force-transferringly coupled to the magnet arrangement by way of a force field and/or a fluid.

As a result of the non-physical coupling of the magnet arrangement to the drive apparatus via a force field and/or a fluid, the magnetic isolating apparatus according to the present invention can be implemented compactly without a large installation space requirement, or at least with less of an installation space requirement than in the existing art. The drive-force-transferring mechanical means, such as a rod or cable, which are known from the existing art cited above can be omitted, and no installation space therefore needs to be furnished for them. The moving mass is thus smaller, with no change in the magnetic field of the magnet arrangement.

Because the magnet arrangement itself encompasses at least one magnet so that a magnetic field proceeds from it, a magnetic field is advantageous as a drive-force-transferring force field. The fluid that alternatively or additionally transfers drive force can in principle be a gas or a liquid. Liquid has the advantage of incompressibility, so that with a liquid, drive force can be transferred with zero backlash from the drive apparatus to the magnet arrangement through fluid conduits of any kind, in particular of any shape.

A gas is nevertheless preferred as a fluid, since a pipetting apparatus can then be used as a drive apparatus of the magnetic isolating apparatus. Pipetting apparatuses, as embodied for usual laboratory equipment, not only comprise a pressure modification apparatus for modifying the pressure of a working fluid that is actually intended for aspirating and dispensing metered liquids, but furthermore comprise motion drives for moving the pipetting channel along the pipetting channel axis along which the pipetting channel extends, and along two motion axes that are orthogonal both to one another and each to the pipetting channel axis. The pipetting apparatus can thus serve not only as a fluidically coupled drive apparatus of the magnetic isolating apparatus but in general as a carrying and moving apparatus of the magnetic isolating apparatus. The pipetting apparatus is thus usable for moving the isolating apparatus in the motion space of the pipetting apparatus and thus for achieving immersion into the aforementioned suspension, withdrawal therefrom, and motion parallel to a laboratory bench surface, for example to unload, at a different location, particles that have been removed magnetically from the suspension and are adhering to the immersion portion. For this purpose, the pipetting channel axis is preferably oriented orthogonally to the laboratory bench surface. The laboratory bench and its surface can be an integral constituent of the pipetting apparatus.

The carrying and moving function of the pipetting apparatus is usable even when the drive apparatus is coupled to the magnet arrangement only by way of the force field and a fluidic drive force coupling therefore does not exist.

Thanks to the non-physical coupling of the drive apparatus to the magnet arrangement, the drive apparatus can furthermore be arranged spatially more freely, i.e. in consideration of fewer boundary conditions, than in the case of the mechanical couplings, known from the existing art, of the drive apparatus to the magnet arrangement.

A "drive apparatus" refers here to that apparatus of the isolating apparatus which furnishes, in the form utilized for shifting, the energy required for shifting the magnet arrangement between the active position and the inactive position. In the case of a force-field coupling this can be an electromagnet generating a magnetic field constituting the force field, or a shiftable permanent magnet generating the force field. In the case of fluidic coupling it can be any pressure-modification apparatus, i.e. for example a pump, or a pressure reservoir that can be switched in and out via a valve in order to act on the magnet arrangement; the pump can in turn be a continuously operating pump or a piston-cylinder arrangement. In the case of a continuously operating pump, its pump effect can in turn be capable of being switched in and out with interposition of a switchable valve, or the effect of the pump can be switched in and out by simply switching the pump on and off.

When it is stated above that in the case of a fluidic coupling, a pipetting apparatus can be a "drive apparatus" of the magnetic isolation apparatus, this is correct at an approximate level of abstraction. Upon more-detailed consideration of the pipetting apparatus, its pressure modification apparatus is the drive apparatus of the magnetic isolating apparatus, since it furnishes the modification of a fluid pressure which is necessary for shifting the magnet arrangement.

In order to be able to effect laboratory operation at a high level of hygiene, provision can be made that the magnetic isolating apparatus comprises a sheath that surrounds the magnet arrangement orthogonally to the guidance path radially externally at least in the active position, and along the guidance path on the side facing away from the inactive position. Wetting of the magnet arrangement by the suspension into which the immersion portion of the isolating apparatus dips can thus be avoided. This is not intended to mean, however, that such wetting must be prevented. For example, it is also conceivable that wetting of the magnet arrangement by the suspension is permissible, and that any suspension, or particles magnetically extracted from the suspension, adhering to the magnet arrangement are wiped away from the magnet arrangement upon shifting thereof from the active position to the inactive position. The guidance apparatus can have for this purpose, for example, a wiper lip that is provided in such a way that the magnet arrangement wipes along it upon shifting from the active position into the inactive position.

Utilization of the sheath as a protective sheath and thus, as it were, as a wetting protection shield for the magnet arrangement when the isolating apparatus is used as intended, is nevertheless preferred over the wiper solution described above, because of the higher level of hygiene. In this case a longitudinal end of the sheath located closer to the active position of the magnet arrangement, constituting an immersion longitudinal end of the sheath, can form the immersion portion of the isolation apparatus. It is not to be excluded, however, that the immersion portion of the isolating apparatus is constituted by a soft-magnetic tip to which the magnet arrangement comes closer in the active position than in the inactive position, preferably making direct contact.

The sheath can be provided permanently on the isolating apparatus. In this case after an immersion operation the sheath can be conveyed into a cleaning station, for example immersed into a cleaning solution, where any suspension residues that are present, which also include solid particles received in the suspension, are removed.

It is preferred, however, because it is more hygienic, to provide the sheath intentionally detachably on the isolating apparatus. In this case the sheath is received on the isolating apparatus as a disposable or single-use sheath for one immersion operation, and after completion of the working operation encompassing the immersion operation it is detached from the isolating apparatus and replaced by a new, clean, and hitherto unused sheath for a subsequent working operation.

For simple but precise handling of the magnetic isolation apparatus in a laboratory, the isolating apparatus can comprise a coupling arrangement that is coupled at a first coupling point, constituting a guidance coupling point, to the guidance apparatus, and is embodied at a second coupling point, different from the first coupling point and constituting an apparatus coupling point, for detachable coupling to a pipetting channel of a pipetting apparatus.

As has already been described above, the pipetting apparatus can be used at least to move the magnetic isolating apparatus, in the state coupled onto the pipetting channel, three-dimensionally in the motion space of the pipetting apparatus. A separate manipulation apparatus for the isolating apparatus is then not required if the laboratory using the isolation apparatus already possesses a pipetting apparatus.

Controlled motion of the isolating apparatus in the motion space of the pipetting apparatus is advantageous both for force-field coupling and for fluid coupling between the drive apparatus and magnet apparatus. In addition, with a corresponding embodiment of the coupling arrangement in the context of a fluidic coupling between the drive apparatus and magnet arrangement, the pipetting apparatus or its pipetting channel can also be used as a drive apparatus of the isolating apparatus. This is discussed in more detail below.

For connection to the isolating apparatus, the sheath, in particular a longitudinal end of the sheath located closer to the inactive position, can be secured—preferably (for the reasons recited above) detachably—on the guidance apparatus and/or on the coupling arrangement.

The sheath is preferably secured on the coupling arrangement, so that the sheath can surround not only the magnet arrangement in its active position but the entire guidance apparatus, and thus protect it from contact with suspension. When a sheath is provided on the isolating apparatus, the guidance apparatus is therefore preferably located along the guidance path completely in the region of the sheath, and is surrounded by the latter, with respect to the guidance path, at least radially externally and axially in an immersion direction.

The guidance apparatus can comprise a guidance hose or a guidance tube or a guidance rod, which guides the magnet arrangement for shifting between the active position and inactive position. The advantage of a guidance hose is the almost arbitrary three-dimensional conformation that it can assume, although this entails limitations in the physical conformation of the magnet arrangement, since it must also be able to move reliably through curved hose configurations.

A guidance tube in the form of a rectilinear guidance tube is preferred, since it has minimum weight or mass along with maximum guidance reliability; and a comparatively large magnet arrangement, for example one that is long in the direction of the guidance path, can be guided therein. A guidance rod or a guidance tube can pass centrally through the magnet arrangement, so that the magnet arrangement can then be embodied with a passthrough opening. This configuration of the magnet arrangement with the guidance apparatus passing through is less preferred, however, since because of the passthrough opening of the magnet arrangement, its magnetic field is considerably weakened as compared with a solid magnet arrangement having the same outside dimensions.

The magnet arrangement preferably comprises a permanent magnet, so that the magnetic field of the magnet arrangement is constantly available without external energy delivery. The magnetic field proceeding from the magnet arrangement is preferably brought about exclusively by at least one permanent magnet, thus precluding the magnet arrangement from acting as a heat source, as might be the case when an electromagnet is used.

In order to furnish a magnetic field that is as strong as possible using a magnet arrangement that is as small as possible, it is therefore preferred if the guidance tube surrounds the magnet arrangement radially externally with reference to a tube axis coincident with the guidance path. The guidance tube can then furthermore also, in addition to the aforementioned sheath, contribute to protecting the magnet arrangement.

In particular for effective fluidic coupling between the drive apparatus and magnet arrangement, it is preferred if the magnet arrangement comprises a sealing arrangement that seals against the inner wall of the guidance tube and divides the volume enclosed by the guidance tube into an actuation volume closer to the inactive position and a displacement volume closer to the active position. A pressure difference between the fluid provided in the actuation volume and in the displacement volume can then be continuously maintained and can continuously act force-transferringly on the magnet arrangement.

The actuation volume, i.e. the volume that communicates directly with the fluidically coupled drive apparatus, and the displacement volume, i.e. the volume that is separated from the actuation volume by the magnet arrangement, in particular by the sealing arrangement, are variable, the sum of the two volumes being constant.

Instead of using a sealing arrangement, however, it also conceivable for the magnet arrangement to be received in the guidance tube with a small radial annular gap width. The physical friction occurring between the magnet arrangement and the guidance tube can then be low. The annular gap between the magnet arrangement, which in this embodiment preferably itself acts as a piston, and the guidance tube can moreover have such small dimensions that while a change in the fluid pressure in the actuation volume with respect to the fluid pressure in the displacement volume can in principle be equalized by overflow through the annular gap past the magnet arrangement, that overflow nevertheless takes so long, because of the small dimension of the annular gap and the high flow resistance caused thereby, that the magnet arrangement reaches its destination position (inactive position or active position) before the pressure difference, generated by the drive apparatus, between the fluid in the actuation volume and the fluid in the displacement volume has decreased too greatly or has in fact equalized.

In principle, the magnet arrangement guided in the guidance tube divides the guidance tube into two portions or two sides. These are on the one hand the actuation side having the actuation volume delimited by the guidance tube and the magnet arrangement and optionally by the coupling arrangement, and on the other hand the displacement side having the displacement volume delimited by the guidance tube and the magnet arrangement and optionally by the sheath. The actuation side is the side on which the drive apparatus is attached, so that a change in the fluid pressure produced by it acts directly on the fluid in the actuation volume. As a result of the force applied by the fluid pressure on the magnet arrangement, the latter becomes shifted in the guidance tube, and as a result of that shift the pressure of the fluid received in the displacement volume becomes indirectly modified; according to an advantageous refinement of the invention, as the displacement volume becomes smaller, fluid becomes expelled and therefore displaced out of it, and as the displacement volume becomes larger, fluid preferably flows back into the displacement volume in order to prevent the pressure in the displacement volume from changing sufficiently, and the pressure difference between the fluid in the displacement volume and the fluid in the actuation volume from decreasing sufficiently, as a result of the motion of the magnet arrangement, that the motion of the magnet arrangement undesirably comes to a standstill prematurely. Thanks to the capability for fluid to be expelled from the displacement volume, and for fluid to flow back into the displacement volume, even long shifting travel distances can be reliably implemented by the non-physical coupling between the drive apparatus and magnet arrangement.

One such capability for allowing fluid to be expelled from the displacement volume and to flow back into it can be implemented in terms of design, with no appreciable installation space requirement, by the fact that the sheath radially externally surrounds the guidance tube, a gas-conveying conduit that opens into the displacement volume of the guidance tube being embodied radially between the guidance tube, and optionally the coupling arrangement, and the sheath. The gas-conveying conduit can be constituted, for example, by one or several grooves in the radially outer side of the guidance tube facing toward the sheath, and/or by one or several grooves on the radially inner side of the sheath facing toward the guidance tube.

A maximally large cross-sectional area of the gas-conveying conduit can be constituted by way of ribs, protruding in a radial direction, on the radially outer side of the guidance tube facing toward the sheath and/or on the radially inner side of the sheath facing toward the guidance tube. The ribs are then preferably spacing-determining in terms of the radial spacing between the guidance tube and sheath. These ribs need not extend axially along the guidance path over the entire length along which the sheath and guidance tube together extend. It is sufficient if ribs spaced away from one another axially, i.e. along the guidance path, are embodied on the one and/or the other component, so that tilting of the sheath and guidance tube relative to one another around a tilt axis orthogonal to the guidance path is precluded.

For clarification, be it noted that a "groove" exists if a recess forming the groove has, in a circumferential direction, a smaller dimension than the component portions delimiting the recess in a circumferential direction; and that a "rib" exists when a component portion forming the rib has, in a circumferential direction, a smaller dimension than the recesses delimiting the component portion in a circumferential direction.

An annular gap optionally interrupted by a plurality of ribs in a circumferential direction can thus radially form the gas-conveying conduit between the guidance tube and sheath. The gas-conveying conduit is connected at its one end region to the displacement volume, and is connected at its oppositely located end region to a fluid reservoir having a substantially constant pressure, preferably to the ambient atmosphere, so that a constant pressure can be furnished in the displacement volume.

As has been described above, the most effective capability for separating the two volumes (actuation volume and displacement volume) from one another is the use of a sealing arrangement. In principle, this sealing arrangement can be provided on the magnet arrangement directly, for example by adhesive bonding or by placement on a positive engagement configuration embodied on the magnet arrangement, for example in a receiving annular gap. Permanent magnets having a strong magnetic field in terms of their weight or volume are, however, specifically preferably made of rare earths, which are extremely difficult to machine. The sealing arrangement can therefore be carried by a piston that is embodied separately from the magnet arrangement and is connected to the magnet arrangement for motion together. The piston can be embodied to be arbitrarily short along the guidance path, for example shorter than the magnet arrangement itself, so that its only tasks are to carry the sealing arrangement and to furnish a permanent connection to the magnet arrangement. The piston can be constituted from a material that is easier to join to the magnet arrangement, by adhesion or by positive engagement, than the material of the sealing arrangement.

In order to constantly furnish an at least minimal displacement volume that is connected to the aforementioned fluid reservoir having a constant pressure, in particular to the ambient atmosphere, the magnet arrangement is preferably connected, on a side facing toward the displacement volume or in a region of the piston located in the displacement volume, to the piston. The reason is that this ensures that even when the piston reaches an end position, there remains between the sealing arrangement and the longitudinal end of the guidance arrangement a spacing that depends on the dimensions of the magnet arrangement. The result of this spacing is always to furnish a minimum residual displacement volume that communicates with the constant-pressure fluid reservoir.

In order to decrease friction between the magnet arrangement and guidance apparatus, the permanent magnet of the magnet arrangement can be surrounded by a casing. This casing can be a plastic sheath, for example PTFE or polyolefin to name only two possibilities. The permanent magnet having no coating and no casing can also, however, constitute the magnet arrangement.

If the spatial conditions of the suspension container or other space-related boundary conditions require it, a piston rod that connects the piston and the magnet arrangement for motion together can be arranged between the piston and the magnet arrangement. As a result, even if the shifting travel length of the piston and of the magnet arrangement is short, the magnet arrangement can be provided in the active position at a distance from the coupling arrangement which is substantially longer than the shifting travel distance alone.

The guidance apparatus then does not need to be in direct guidance engagement with the magnet arrangement. It can instead guide the magnet arrangement indirectly to move along the guidance path. For that purpose, the guidance apparatus can directly guide the piston and, if applicable, also the piston rod to move along the guidance path. The guidance apparatus can thereby be embodied to be considerably shorter than if it were in guidance engagement with the piston and with the magnet arrangement. The magnet arrangement can then, in any operating position (active position, inactive position, and any intermediate position located between them), be located axially outside the guidance tube with reference to the tube axis of the guidance tube. A spacing between the magnet arrangement in the active position and the suspension can thereby be decreased.

Utilization of the aforementioned sheath allows the magnet arrangement to be protected from external influences.

The guidance tube of the guidance apparatus can comprise, at its longitudinal end closer to the active position, a guidance component that closes off or constricts the guidance tube and is passed through by the piston rod, and that guides the piston rod while the piston is guided in the guidance tube itself.

In order to be able to ensure that the gas-conveying conduit constituted between the guidance tube and sheath is communicatingly connected to the displacement volume, provision can be made that the guidance tube comprises, in its end region located closer to the active position, in particular at its longitudinal end located closer to the active position, openings passing radially through the guidance tube.

Alternatively thereto, the guidance tube can extend, at its longitudinal end located closer to the active position of the magnet arrangement, not as far as a bottom or a shoulder configuration of the sheath surrounding the guidance tube, so that a completely encircling annular gap between the guidance tube and sheath can exist in that region.

In the case alluded to above of a guidance tube passing through the magnet arrangement, the gas-conveying conduit can be embodied in the guidance tube, so that the displacement volume is in communicating connection, through the guidance tube, with a fluid reservoir having a constant pressure, in particular with the ambient atmosphere. In this case either the magnet arrangement is radially externally surrounded by a further tube in order to furnish defined actuation and displacement volumes, or the volumes are defined by the sheath that radially externally surrounds the magnet arrangement. In the latter case a sealing arrangement should preferably be provided, which then seals against the sheath. It is conceivably possible for there to exist, even without a sealing arrangement between the sheath and magnet arrangement, an annular gap of such small dimensions that a pressure equalization between the actuation and displacement volumes through the annular gap takes more time than the shifting motion of the magnet arrangement. Such a small annular gap between the magnet arrangement and sheath makes it difficult, however, to replace the sheath after use with an unused, clean sheath.

To permit the coupling arrangement couplable to a pipetting channel also to transfer into the actuation volume, located closer to the apparatus coupling point, a pressure change of the working fluid of the pipetting channel brought about by the pipetting channel, the coupling arrangement can comprise a connecting conduit that connects the apparatus coupling point to the volume enclosed by the guidance tube. For the reasons recited above, the connected volume is preferably the actuation volume. The connection allows fluid and fluid pressure to be transferred between the pipetting channel filled with working fluid and the volume enclosed by the guidance tube, in particular the actuation volume, along with the fluid contained therein.

Because this isolating apparatus, having a magnet apparatus fluidically couplable to a drive apparatus in order to transfer drive force, can be manipulated independently of a pipetting apparatus constituting a drive apparatus, the present Application also relates in principle to a magnetic isolating apparatus for isolating magnetic particles from a suspension, the isolating apparatus comprising:

- an immersion portion that is embodied for temporary immersion into the suspension;
- a guidance apparatus extending along a guidance path;
- a magnet arrangement that is guided by the guidance apparatus shiftably between an active position located closer to the immersion portion and an inactive position located along the guidance path farther from the immersion portion, so that a magnetic field in the region of the immersion portion is modifiable by shifting the magnet arrangement between the active position and the inactive position; and
- a coupling arrangement that is coupled to the guidance apparatus at a first coupling point constituting a guidance coupling point, and is embodied at a second coupling point, different from the first coupling point and constituting an apparatus coupling point, for detachable coupling to a pipetting channel of a pipetting apparatus, the coupling arrangement comprising a connecting conduit that fluid- and pressure-transferringly connects the apparatus coupling point to a volume enclosed by the guidance tube, the magnet arrangement being embodied to transfer, by way of a fluid, a drive force that brings about a shift between the active position and inactive position. This magnetic isolating apparatus also achieves the object described above. Embodiment of the magnet arrangement for fluid-based transfer of drive force is accomplished preferably by the fact that either the magnet arrangement is itself embodied as a piston, as described above, or it is coupled to a separately embodied piston for motion together. Advantageous refinements of the immersion portion, the guidance apparatus, the magnet arrangement, and/or the coupling arrangement which are indicated in this Application are also applicable to the magnetic isolating apparatus that is described here and has no drive apparatus.

Advantageously, a holding apparatus that holds the magnet apparatus in the inactive position can be provided in the region of the inactive position, so that constant exertion and transfer of holding force or drive force by the drive apparatus in order to hold the magnet arrangement in the inactive position can be omitted. As a simple but effective utilization of the magnetic field of the magnet arrangement, the holding apparatus can encompass a holding magnet, preferably a permanent holding magnet in order to avoid an unnecessary energy supply. It can also be sufficient to equip or embody at least one end region of the coupling arrangement, facing toward the inactive position of the magnet arrangement, with a soft-magnetic material, for example with a ferromagnetic or ferrimagnetic material that is not permanently magnetized but is magnetizable.

The aforementioned guidance component that guides the piston rod can be a holding component, constituting a permanently magnetic or soft-magnetic component, of the holding apparatus.

Because the active position usually lies geodetically below the inactive position, the magnet arrangement can easily be held in position by a bottom of the guidance apparatus and/or of the sheath. This too then requires no exertion of force by the drive apparatus.

It is moreover sufficient, in order to bring about the advantages of the present invention in a very simple embodiment, if the magnet arrangement is shiftable by the drive apparatus only from the active position into the inactive position, and if the magnet arrangement can be shifted in the opposite direction from the inactive position into the active position by gravity. Preferably, however, the drive apparatus is embodied to drive the magnet arrangement in both opposite shifting directions.

For drive-force-transferring coupling between the drive apparatus and magnet arrangement by means of a force field, the isolating apparatus can comprise a control magnet arrangement whose magnetic field, constituting the force field, in the region of the guidance path is modifiable. In a less preferred case the control magnet arrangement can be a spatially shiftable permanent-magnet arrangement, but it preferably encompasses a switchable electromagnet that generates a magnetic field as a function of the current flow through its coils. The electromagnet can then advantageously be provided in positionally invariable fashion on the isolation apparatus.

As a very general principle, the isolating apparatus can comprise a base body that is coupled to the guidance apparatus and thus carries the guidance apparatus. The base body can be the aforementioned coupling arrangement, so that the isolating apparatus is couplable to the pipetting apparatus. The base body can also, however, be embodied for manual grasping in order to move the isolating apparatus manually between different containers.

According to a refinement of the present invention, the control magnet arrangement can be provided on the base body. This has the advantage that the isolating apparatus can be used with any containers and container carriers.

Alternatively or additionally, the isolating apparatus can comprise a container embodied for reception of the suspension and/or a container carrier embodied for reception of the container, the control magnet arrangement being provided on the container and/or on the container carrier. The base body, which then does not necessarily need to carry a control magnet arrangement, can then be small, i.e. can be embodied to require little installation space. The isolating apparatus can then be embodied with reference to the guidance track to be so slender that, on a pipetting head having a plurality of pipetting channels, a plurality of pipetting channels, or even all pipetting channels, can be coupled simultaneously to a magnetic isolating apparatus of the present Application. This also applies to a magnetic isolating apparatus coupled only fluidically to the pipetting apparatus that constitutes a drive apparatus.

In this case the control magnet arrangement is preferably provided on the container carrier, since the latter can be equipped, more easily than can the container, with the necessary energy supply for energization of the control magnet arrangement that advantageously comprises an electromagnet, since in the laboratory the container carrier is usually moved less often than the container received by it.

The container carrier then preferably comprises a receiving recess, for example a depression, that is embodied to receive a container portion. The receiving recess is preferably embodied complementarily to the container portion that is to be received in it.

The control magnet arrangement can then be provided on the container carrier so as to surround the receiving recess, and/or provided below a placement surface on which the container, received on the container carrier, stands as intended on the container carrier.

The electromagnet preferably encompassed by the control magnet arrangement can be embodied to develop, proceeding from its placement location in the container carrier, a magnetic field that is strong enough to shift the magnet arrangement from the inactive position into the active position and back again.

According to an alternative embodiment of the control magnet arrangement which functions without current, the control magnet arrangement can encompass on the container carrier or on the container only a permanent magnet, which is nevertheless strong enough, when the guidance arrangement and the magnet arrangement guided therein are brought sufficiently close to the control magnet arrangement, to overcome the holding force of the holding apparatus against the action of the holding apparatus that is preferably provided, and to shift the magnet arrangement into the active position that is closer to the immersion portion and that is therefore, upon approach as intended to the container carrier, located closer to the control magnet arrangement.

The magnet arrangement is then shifted into the active position upon approach to the suspension that is to be processed or during immersion thereinto, without requiring a separate switching operation, or even energy delivery, for that purpose.

Once the separating apparatus has been pulled back out of the suspension, the magnet arrangement remains in the active position in response to gravity and is conveyed, along with the magnetic particles withdrawn from the suspension and adhering to its immersion portion, to an unloading vessel comprising a further control magnet arrangement that has, however, a polarization opposite to that of the container or container carrier. Upon approach to this further control magnet arrangement, the magnet arrangement becomes shifted by the magnetic field of the further control magnet arrangement into the inactive position, once again without a separate switching operation or energy delivery; and the particles deposited externally on the immersion portion can fall or flow off the immersion portion.

The holding apparatus then holds the magnet arrangement until it again approaches the control magnet arrangement of the container receiving the suspension, or of the container carrier carrying it, in the inactive position.

Although this embodiment is technically possible it is not preferred, since in this embodiment a magnetic field constantly acts on the suspension and on the unloading vessel.

The use of an electromagnet, conversely, allows a magnetic field for shifting the magnet arrangement to be created and maintained only for as long as is actually necessary for shifting the magnet arrangement between the active position and inactive position. The magnetic field of the control magnet arrangement can be switched off after completion of the shifting motion, since the magnet arrangement is preferably held, either by the holding apparatus or by gravity, in the one or other position from among the inactive position and active position.

The present invention will be explained in further detail below with reference to the attached drawings, in which.

Figure 1:
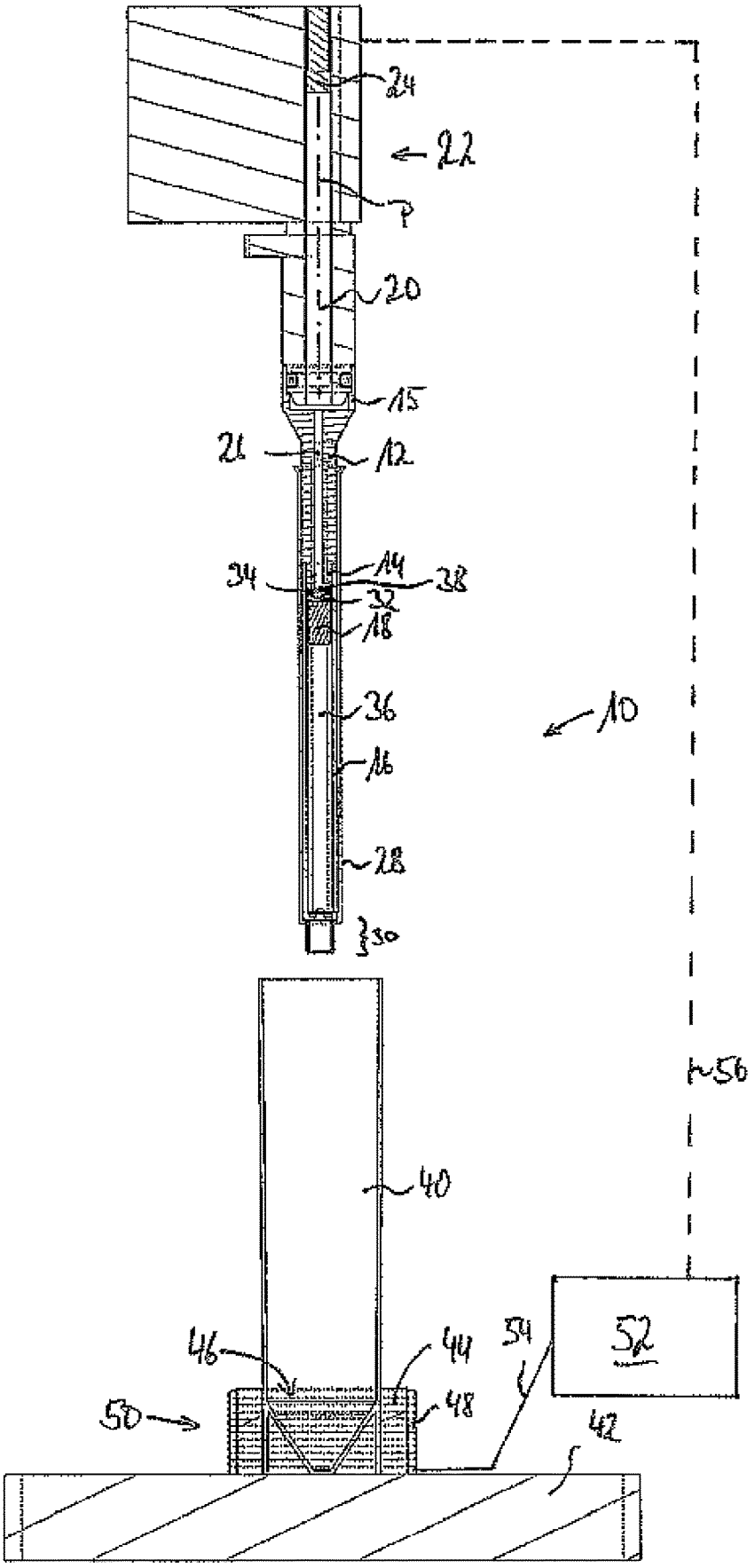
FIG. 1 is a longitudinal section view through a first embodiment according to the present invention of a magnetic isolating apparatus of the present invention, having the magnet arrangement in the inactive position and having an immersion portion of the isolating apparatus not yet immersed into a suspension that is furnished.

In FIGS. 1 to 7, a first embodiment according to the present invention of the magnetic isolating apparatus of the present application is labeled in general with the number 10. Magnetic isolating apparatus 10 encompasses a coupling arrangement 12 on which a guidance coupling point 14 is embodied at one end, and an apparatus coupling point 15 at the other end. Secured on guidance coupling point 14 is a guidance tube 16 in which a magnet arrangement 18 is guided shiftably along a guidance path F, depicted in FIG. 2, between the inactive position shown in FIG. 1 and the active position shown in FIG. 2. Guidance tube 16 extends along a tube axis R that is collinear with guidance path F.

Apparatus coupling point 15 comprises a coupling configuration that is embodied for detachable coupling to a pipetting channel 20 of a pipetting apparatus 22. The coupling configuration of apparatus coupling point 15 corresponds to the coupling configuration of a pipetting tip detachably couplable onto pipetting channel 20.

A pipetting piston 24 is received movably in a manner known per se in pipetting channel 20 that extends along a pipetting channel axis P, in order to allow the pressure of a working fluid in pipetting channel 20 to be modified by movement of pipetting piston 24 and thereby to allow, for example, an aspiration operation and/or a dispensing operation to be performed when a pipetting tip is coupled onto pipetting channel 20.

In the present exemplifying embodiment, pipetting apparatus 22 constitutes a drive apparatus of magnetic isolating apparatus 10. Magnet arrangement 18 is therefore at least also fluidically coupled to pipetting apparatus 22 constituting the drive apparatus. Coupling arrangement 12 comprises for that purpose a connecting conduit 26 that passes centrally through it and passes completely through the coupling arrangement from apparatus coupling point 15 to guidance coupling point 14, so that pressure of the working fluid in pipetting channel 20 can act directly on magnet arrangement 18.

Connecting conduit 26 is preferably embodied cylindrically. Its cylinder axis is collinear with pipetting channel axis P and also collinear with guidance path F (see FIG. 2). Isolating apparatus 10 furthermore comprises a schematically cup-shaped sheath 28 that is arranged detachably, namely slidably along guidance path F, on coupling arrangement 12 and on guidance tube 16. In order to achieve a high standard of hygiene, sheath 28 is replaced after each working operation, encompassing an immersion operation, of isolating apparatus 10. Sheath 28 is therefore a single-use or disposable sheath 28.

Sheath 28 radially externally surrounds guidance tube 16 along its entire axial extent with respect to its tube axis, and constitutes an immersion portion 30 at its longitudinal end remote from coupling arrangement 12. This immersion portion 30 is embodied to be immersed into a suspension in order to remove magnetic particles therefrom as a result of the action of the magnetic field proceeding from magnet arrangement 18.

Immersion portion 30 of sheath 18, and thus of isolating apparatus 10, is embodied with a smaller diameter than the remaining portion of sheath 28. The diameter of immersion portion 30 of sheath 28 is just large enough to accommodate the cylindrical magnet arrangement 18 therein.

Magnet arrangement 18 is embodied as a solid cylindrical permanent magnet, whose cylinder axis is collinear with guidance path F (see FIG. 2) and which is preferably polarized along the cylinder axis, i.e. has a north or south pole at its one end and the respectively different (south or north) pole at its other end.

At its longitudinal end facing toward coupling arrangement 12, magnet arrangement 18 is connected, for example by adhesive bonding, to a piston 32 for movement together. Piston 32, which is embodied to be substantially shorter than magnet arrangement 18 in the direction of guidance path F, for example less than a third the length of magnet arrangement 18, carries a sealing arrangement 34 that is movable along guidance path F together with piston 32 and seals against the inner side of guidance tube 16.

Sealing arrangement 34 divides the volume enclosed by guidance tube 16, along guidance path F, into a displacement volume 36 located on that side of sealing arrangement 34 which faces away from coupling arrangement 12, and an actuation volume 38 located on that side of sealing arrangement 34 which faces toward coupling arrangement 12.

In the inactive position, shown in FIG. 1, of magnet arrangement 18, actuation volume 38 is minimal and displacement volume 36 is maximal.

Figure 2:
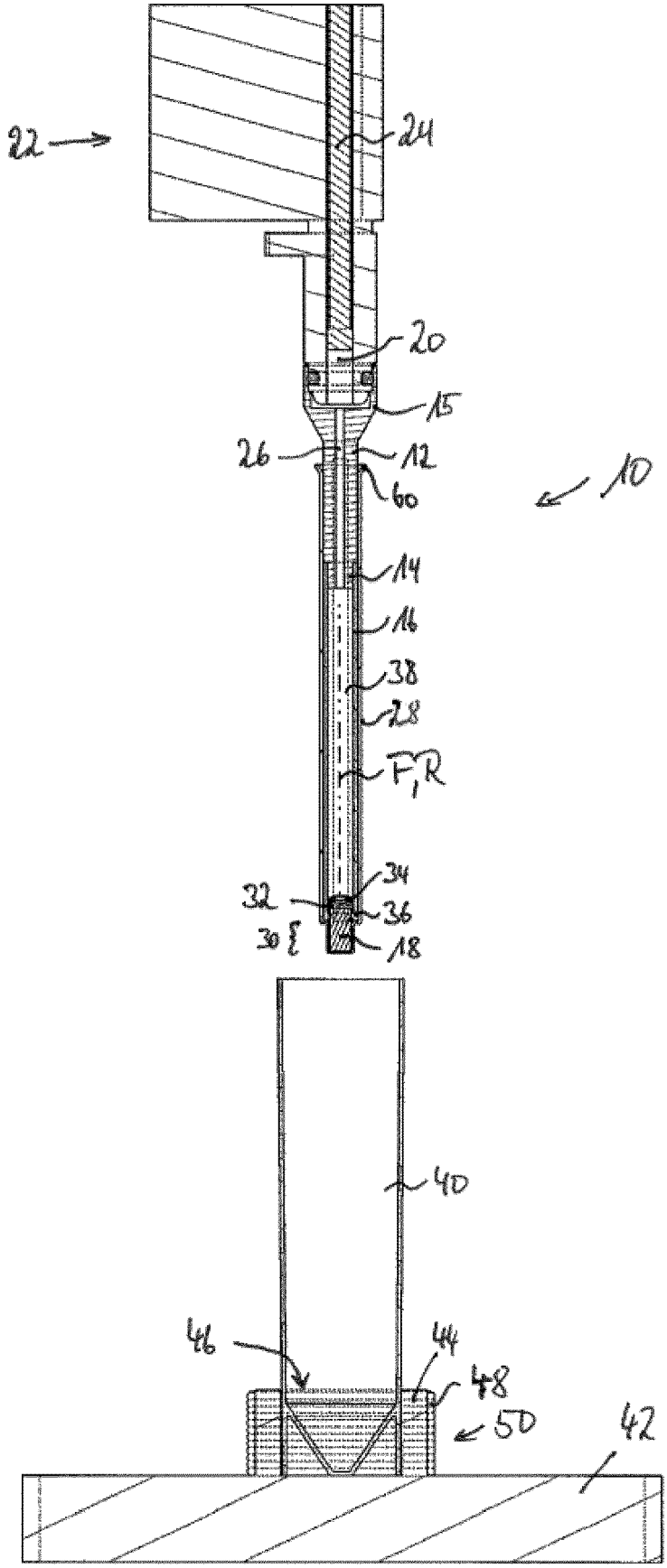
FIG. 2 shows the first embodiment of FIG. 1 with the magnet arrangement shifted into the active position.

Conversely, in the active position, shown in FIG. 2, of magnet arrangement 18, actuation volume 38 is maximal and displacement volume 36 is minimal but not zero.

Actuation volume 38 and displacement volume 36 are variable depending on the relative position of magnet arrangement 18 and of sealing arrangement 34 which is connected thereto for motion together, the sum of actuation volume 38 and displacement volume 36 being substantially constant because of the invariable conformation of guidance tube 16.

Guidance tube 16 and sheath 28 are manufactured from nonmagnetic and non-magnetizable material.

Coupling arrangement 12 is equipped with ferromagnetic material at least at its guidance longitudinal end 14, so that in the inactive position shown in FIG. 1, magnet arrangement 18 is held, because of its magnetic field, in the inactive position by force interaction with coupling arrangement 12. Coupling arrangement 12 could thus be decoupled from pipetting channel 20 without causing magnet arrangement 18 to travel into the active position.

FIG. 1 further depicts a container 40 in which a suspension (not depicted in further detail), made up of a liquid and magnetic particles received therein, is received. Container 40, which is radially externally substantially cylindrical, is received in a container carrier 42 that can likewise be part of isolating apparatus 10. Container carrier 42 comprises a shoulder 44, cylindrical in the exemplifying embodiment depicted, in whose surrounded recess 46 a bottom portion of container 40 is received.

Shoulder 44, having receiving recess 46, is surrounded radially externally by a coil 48 of an electromagnet 50. Electromagnet 50 constitutes a control magnet arrangement for purposes of the present invention.

Alternatively or additionally, a coil of an electromagnetic control magnet arrangement could also be received in coupling arrangement 12, for example surrounding connecting conduit 26. Electromagnet 50 is connected to a control device 52 (depicted only in FIG. 1 in the interest of clarity) that controls the operation of electromagnet 50. Control device 52 can be a control device of pipetting apparatus 22 which also controls the latter's operation. Control device 52 is therefore connected to electromagnet 50 via a signal- and/or energy-transferring lead 54, and can also be connected tin signal- and/or energy-transferring fashion to pipetting apparatus 22 via a lead 56 (depicted merely with dashed lines because it is optional).

FIG. 2 depicts the apparatus of FIG. 1 with magnet arrangement 18 shifted into the active position.

In order to shift magnet arrangement 18 into the active position, pipetting piston 24 was moved into the lower position shown in FIG. 2, with the result that the working fluid pressure in pipetting channel 20 became so greatly increased that magnet arrangement 18 became detached from its coupling arrangement 12, also embodied as a holding apparatus thanks to the use of ferromagnetic material at least at guidance coupling point 14, and became shifted into the active position shown in FIG. 2 in response to the elevated working fluid pressure together with the force of gravity acting along guidance path F.

Figure 3:
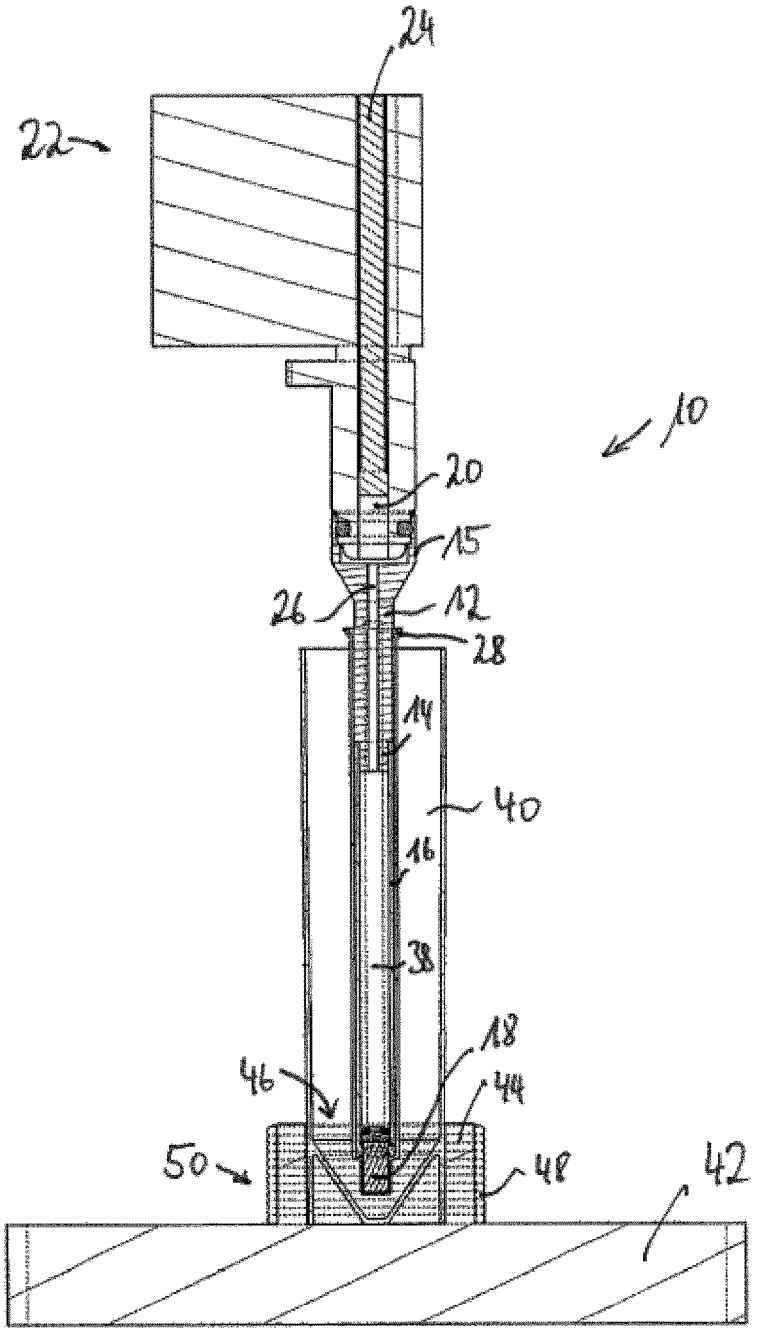
FIG. 3 shows the first embodiment of FIG. 2 with the immersion portion immersed into the suspension.

FIG. 3 depicts the apparatus of FIG. 2 with immersion portion 30 immersed into the suspension (not depicted). The permanent magnetic field proceeding from magnet arrangement 18 thus acts on the suspension.

As a result of the shiftable permanently magnetic magnet arrangement 18, the magnetic field acting in the region of immersion portion 30 of isolating apparatus 10 is variable over time.

Figure 4:
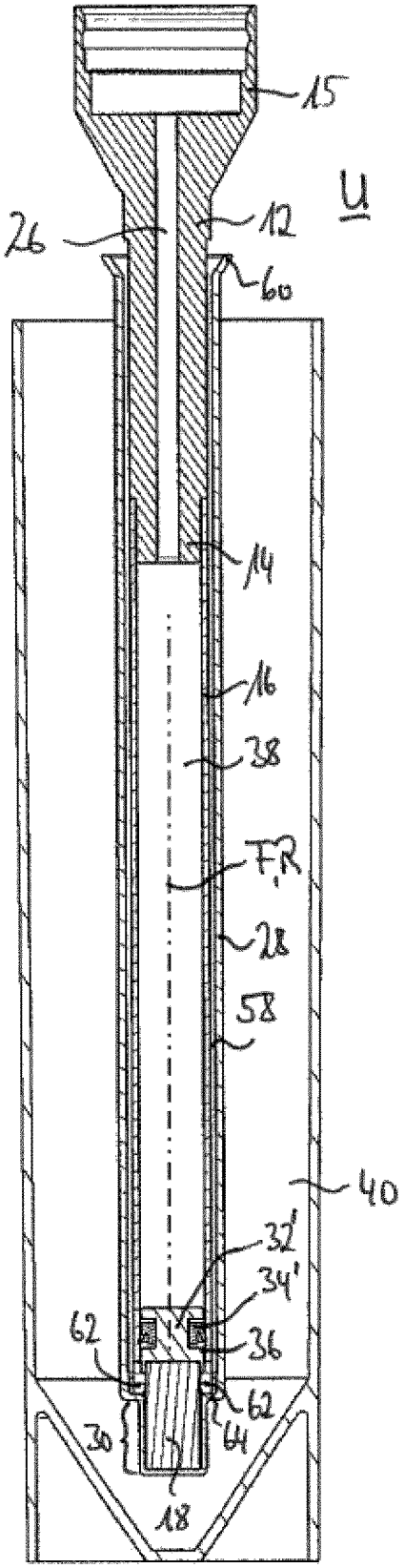
FIG. 4 is an enlarged depiction of the isolating apparatus of FIG. 3 but without a pipetting apparatus.

FIG. 4 is an enlarged depiction of the region from coupling arrangement 12 to immersion portion 30 along with suspension container 40, so that further details of the apparatus can be explained in the enlarged depiction.

As is evident from FIG. 4, there exists between coupling arrangement 12 and guidance tube 16 on the one hand, and that portion of sheath 28 which radially externally surrounds coupling arrangement 12 and guidance tube 16 on the other hand, an annular gap 58 that is connected toward apparatus coupling point 15, via introduction bevel 60 of sheath 28, to external environment U and thus to the atmosphere. External environment U exhibits a pressure level that is substantially constant except for the usual, and in the present case negligible, meteorological pressure fluctuations.

At its longitudinal end located remotely from coupling arrangement 12, guidance tube 16 comprises passthrough openings 62 which pass through guidance tube 16 in a radial direction and through which annular gap 58 communicates with displacement volume 36 that is always present below sealing arrangement 34.

That longitudinal end of guidance tube 16 which is located closer to the active position and farther from coupling arrangement 12 can thus be embodied, for example, in the manner of a crown, so that its peaks can constitute an end stop for shoulder 64, extending in a radial direction, of sheath 28, and the interstices between the peaks, constituting passthrough openings 62, can ensure communication between displacement volume 36 and external environment U.

It is thereby possible, during a shift of magnet arrangement 18 from the inactive position into the active position, to push fluid, in particular gas, particularly preferably air, out of displacement volume 36 into external environment U and, upon shifting of magnet arrangement 18 in the opposite direction, i.e. toward the inactive position, to draw air out of external environment U into displacement volume 36 that is then getting larger, in order to allow fluidically and/or magnetically driven shifting of magnet arrangement 18 to be ensured even over long travel distances with no risk of a decrease, caused by the motion of magnet arrangement 18, in the pressure difference between the fluid pressures in actuation volume 38 and in displacement volume 36.

Sheath 28 is brought close to the magnet arrangement 18 in the region of immersion portion 30 in order to avoid an unnecessary air gap and to achieve maximally effective action of the magnetic field, proceeding from magnet arrangement 18, on the suspension that then surrounds that portion 30. Immersion portion 30 is connected by way of the aforementioned shoulder 64 to that portion of sheath 28 which surrounds guidance tube 16 and coupling arrangement 12.

Ribs can be embodied on coupling arrangement 12, on sheath 28, and/or on guidance tube 16, in particular in the region of that longitudinal end of guidance tube 16 which is closer to the active position, said ribs positioning coupling arrangement 12 and guidance tube 16 on the one hand, and sheath 28 on the other hand, radially with respect to one another so that annular gap 58 definitely exists. If they are embodied on coupling arrangement 12 and on guidance tube 16, the ribs protrude radially outward from them; if they are embodied on sheath 28, they protrude radially inward therefrom.

Be it noted that an alternative embodiment of a piston 32', which differs from piston 32 of FIGS. 1 to 3 and 5 to 7, is depicted in FIG. 4. In the embodiment of piston 32' of FIG. 4, it is embodied in a double-T shape with an encircling groove in which seal arrangement 34', having a sealing lip protruding therefrom, is arranged. Piston 32' encompasses encirclingly, at its mounting longitudinal end, a longitudinal end, facing toward it, of cylindrical magnet arrangement 18, which simplifies the mounting of magnet arrangement 18 on piston 32'. This encompassing embodiment of the piston can also be implemented on piston 32.

The advantage of fluidic actuation of magnetic arrangement 18 for shifting it between the inactive and active positions is that magnet arrangement 18 can be shifted regardless of any approach toward control magnet arrangement 50. It is thus possible to bring magnet arrangement 18 into the active position even before immersion portion 30 arrives in the vicinity of the suspension in which it is to be immersed.

A comparable result could also be achieved, however, by providing a control magnet arrangement in coupling arrangement 12.

The coupling arrangement could then be manufactured by injection-molding of thermoplastic, such that the coils of the control magnet arrangement can be embedded into the material of coupling arrangement 12 in a manner surrounding connecting conduit 26. If magnet arrangement 18 is to be shifted exclusively magnetically, connecting conduit 26 can also be omitted.

A ferromagnetic cylinder can be embedded into coupling arrangement 12, manufactured by injection molding, in the region of its guidance coupling point 14; said cylinder, constituting a soft-magnet component, constitutes a holding apparatus for holding magnet arrangement 18 in the inactive position.

Figure 5:
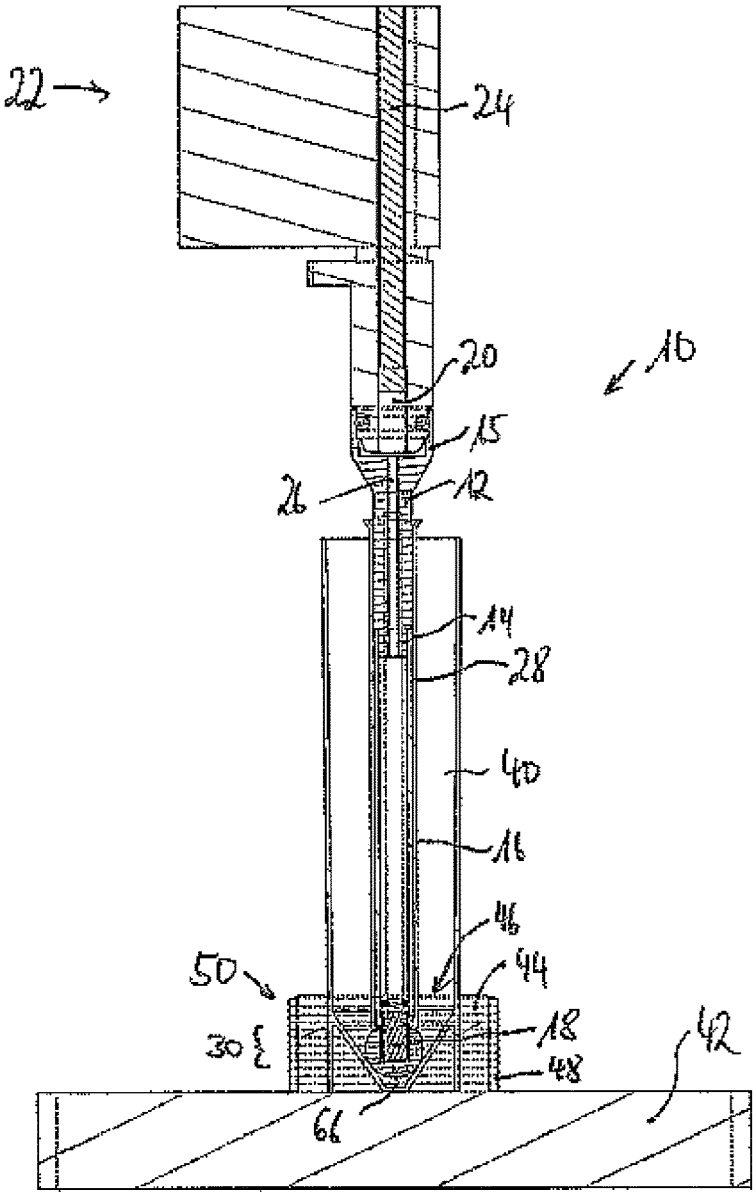
FIG. 5 shows the first embodiment of FIG. 3 with magnetic solid particles of the suspension adhering to the immersion portion.

FIG. 5 depicts the apparatus of FIG. 3 with no change of configuration except that because of the action of the magnetic field of magnet arrangement 18, a globule 66 of soft-magnetic particles from the suspension has become deposited around immersion portion 30.

Figure 6:
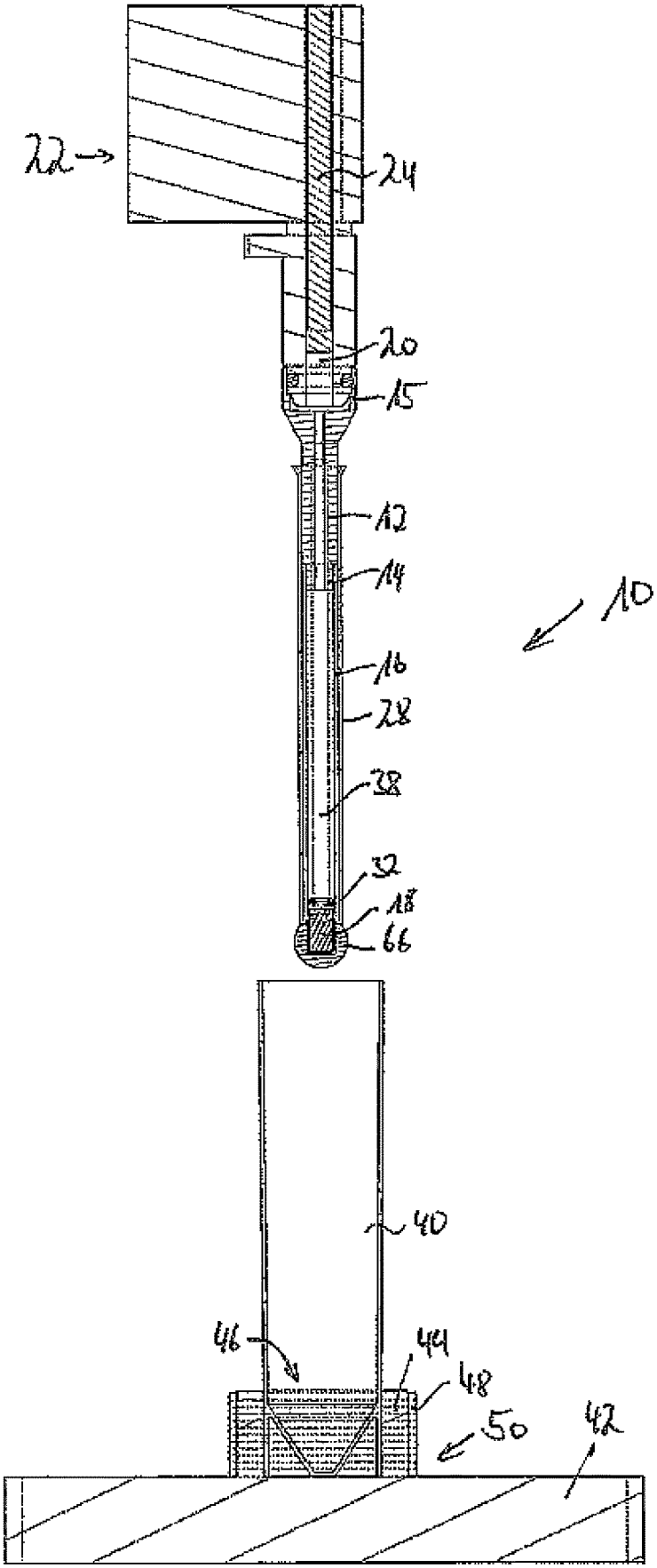
FIG. 6 shows the embodiment of FIG. 5 retracted out of the suspension and out of the container receiving it.

FIG. 6 shows isolating apparatus 10 in the configuration of FIG. 2 but with a particle globule 66 arranged on immersion portion 30.

Figure 7:
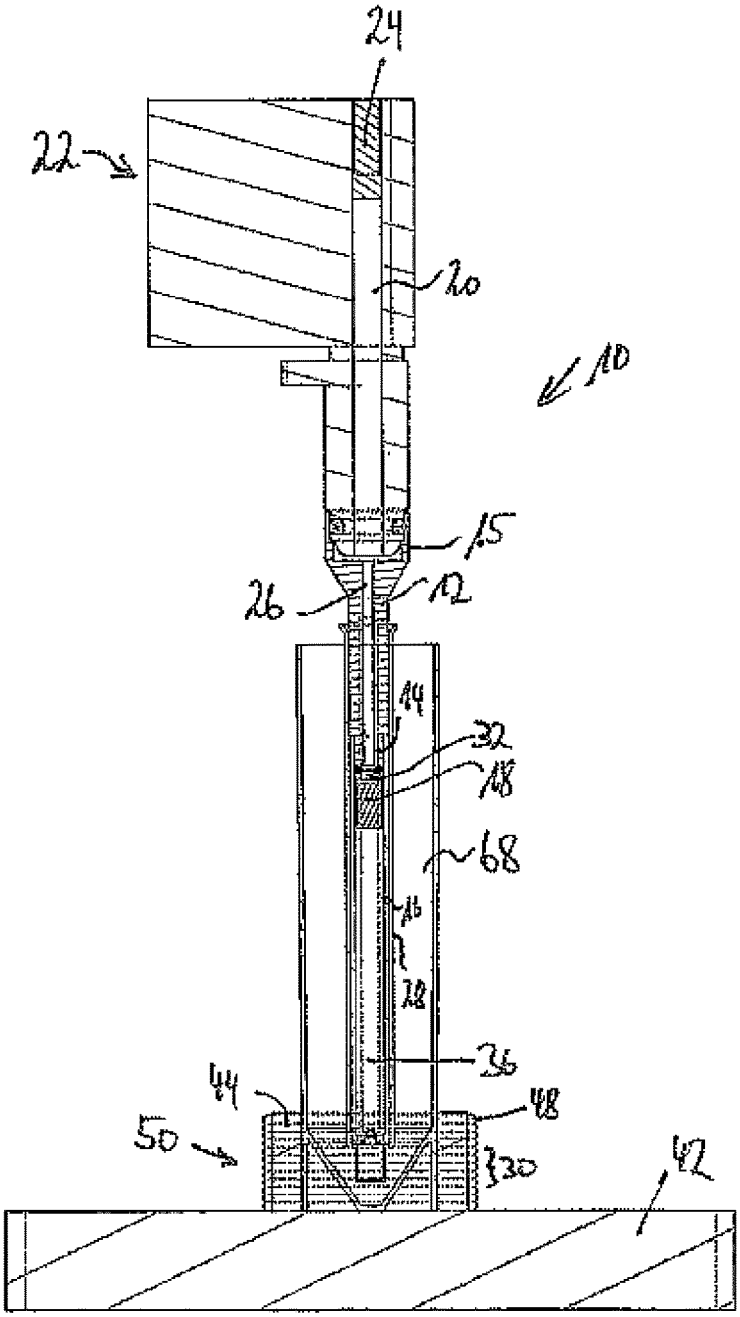
FIG. 7 shows the first embodiment of FIG. 6 lowered into an unloading vessel, with the magnet arrangement in the active position in order to unload the solid particles previously magnetically withdrawn from the suspension.

FIG. 7 shows isolating apparatus 10 immersed into an unloading vessel 68, with magnet arrangement 18 shifted into the inactive position. The shift is accomplished both by the fluidic coupling to pipetting piston 24 and by the action of control magnet arrangement 50. By way of the combined action of a fluid vacuum by means of pipetting piston 24 in pipetting channel 20 on the one hand, and a repulsive magnetic field effect thanks to control magnet arrangement 50, magnet arrangement 18 can be shifted at very high speed from the active position into the inactive position, with the result that the soft-magnetic particles initially adhering to immersion portion 30 are unloaded into unloading vessel 68.

Unloading vessel 68 is identical in design to suspension vessel 40.

Figure 8:
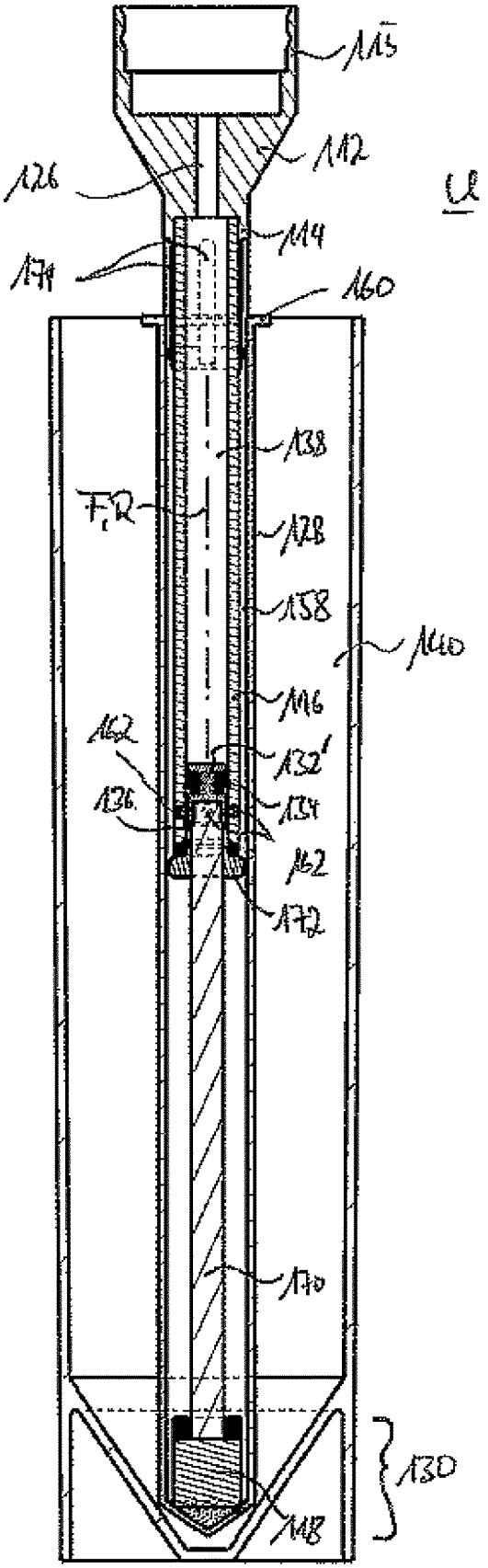
FIG. 8 is a longitudinal section, corresponding to the depiction of FIG. 4, of a second embodiment of the present invention not having a pipetting apparatus as a drive apparatus.
Figure 9:
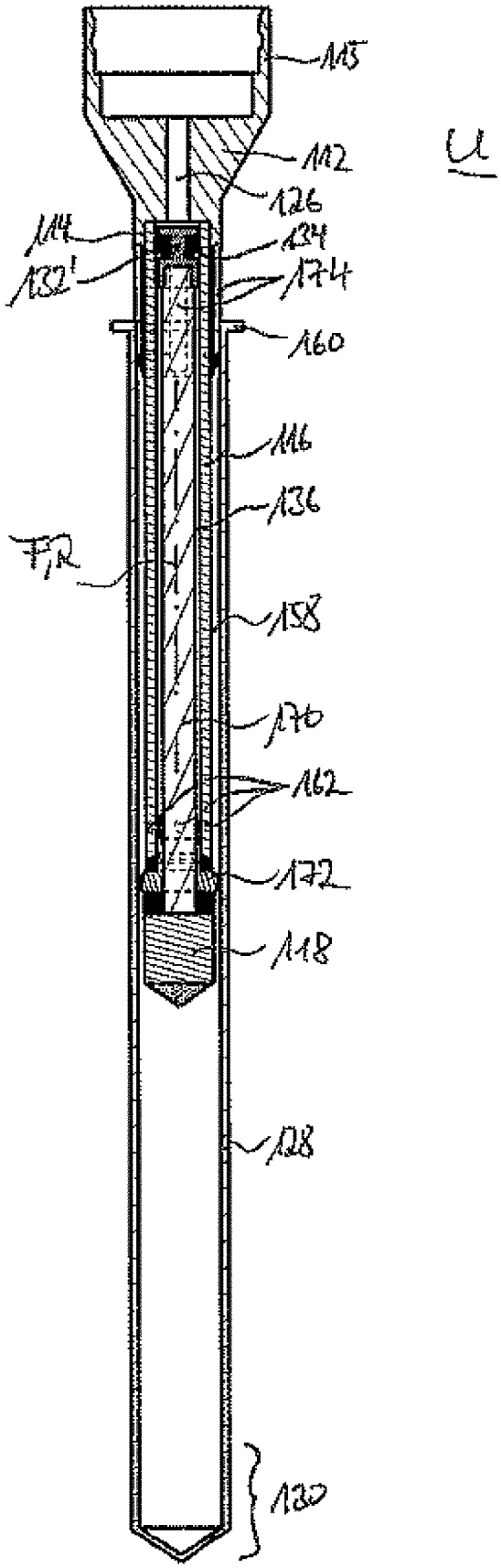
FIG. 9 shows the isolating apparatus of FIG. 8 having no pipetting apparatus and no container, with the magnet arrangement in the inactive position.

FIGS. 8 to 9 depict a second embodiment of the magnetic isolating apparatus of the present invention, but without a pipetting apparatus as a drive apparatus.

Components and component portions that are identical, and function identically, to those in the first embodiment are labeled in the second embodiment with the same reference characters but incremented by 100. The second embodiment will be described below only insofar as it differs from the first embodiment, to the description of which reference is otherwise expressly made for an explanation of the second embodiment as well.

In the second embodiment, piston 132' is connected via a piston rod 170 to magnet arrangement 118. Piston rod 170 is circularly cylindrical at least over a majority of its longitudinal extent, its cylinder axis being oriented collinearly with tube axis R of guidance tube 116.

In guidance tube 116 itself, it is exclusively piston 132' that is guided to move along guidance path F. Arranged at that longitudinal end of guidance tube 116 which is located closer to the active position (shown in FIG. 8) of magnet arrangement 118 is a guidance component 172 through which piston rod 170 passes with a small radial gap, so that guidance component 172 guides piston rod 170. As a result of the direct guidance of piston 132' and of piston rod 170 respectively by guidance tube 116 and by guidance component 172, magnet arrangement 118 is indirectly guided to move along guidance path F. Magnet arrangement 118 is located completely outside guidance tube 116.

As in the first exemplifying embodiment, sheath 128 is secured, with its longitudinal end farther from the active position (see FIG. 8), to coupling arrangement 112. FIGS. 8 and 9 depict grooves 174 embodied on coupling arrangement 112, which are arranged with an equidistant distribution in a circumferential direction around guidance path F and extend in their principal direction of extent along guidance path F. Gas-conveying conduit 158 between sheath 128 and guidance tube 116 is connected to external environment U by way of these grooves 174.

Passthrough openings 162 which pass radially through the guidance tube, and through which displacement volume 136 (which is minimal in FIG. 8) is communicatingly connected to external environment U via gas-conveying conduit 158 and grooves 174, are in turn embodied in the region of that longitudinal end of guidance tube 116 which is closer to guidance component 172 and thus to the active position. In the second embodiment, passthrough openings 162 are provided with a spacing from that longitudinal end of the guidance tube which is closer to the active position, so that the longitudinal end itself can be used for the attachment of guidance component 172.

FIG. 9 depicts the arrangement of FIG. 8, magnet arrangement 118 merely having been shifted into the inactive position. To allow the magnet arrangement to be held securely in the inactive position, guidance component 172 can act as a holding component, and for that purpose can be embodied in permanently magnetic or soft-magnetic fashion so that magnetic holding forces can act between guidance component 172 and magnet arrangement 118 in the inactive position.

As is evident from FIGS. 8 and 9, sheath 128 is embodied to be considerably longer than guidance tube 116 in an axial direction. Sheath 128 both surrounds a majority of guidance tube 116, or in any event a majority of its extent proceeding from the longitudinal end located closer to the active position, and surrounds the entire shifting travel length of magnet arrangement 118.

Guidance component 172 can project radially externally beyond guidance tube 116 in order to brace sheath 128 radially.

The invention claimed is:

1. A magnetic isolating apparatus for isolating magnetic particles from a suspension, the isolating apparatus comprising:

an immersion portion that is embodied for immersion into the suspension;

a guidance apparatus extending along a guidance path;

a magnet arrangement that is guided by the guidance apparatus shiftably between an active position located closer to the immersion portion and an inactive position located along the guidance path farther from the immersion portion, so that a magnetic field in the region of the immersion portion is modifiable by shifting the magnet arrangement between the active position and the inactive position;

a drive apparatus by means of which the magnet arrangement is drivable to move at least in a direction between the active position and the inactive position; and a sheath that surrounds the magnet arrangement orthogonally to the guidance path radially externally at least in the active position, and along the guidance path on the side facing away from the inactive position;

wherein the drive apparatus is non-physically drive-force-transferringly coupled to the magnet arrangement by way of a fluid;

wherein the magnetic isolating apparatus further comprises a coupling arrangement that is coupled at a first coupling point, constituting a guidance coupling point, to the guidance apparatus, and is embodied at a second coupling point, different from the first coupling point and constituting an apparatus coupling point, for detachable coupling to a pipetting channel of a pipetting apparatus;

wherein the guidance apparatus comprises a guidance tube that guides the magnet arrangement for shifting between the active position and inactive position;

wherein the guidance tube surrounds the magnet arrangement radially externally with reference to a tube axis coincident with the guidance path;

wherein the magnet arrangement comprises a sealing arrangement that seals against the inner wall of the guidance tube and divides the volume enclosed by the guidance tube into an actuation volume closer to the inactive position and a displacement volume closer to the active position;

wherein the sheath radially externally surrounds the guidance tube, and a gas-conveying conduit that terminates in the displacement volume of the guidance tube is embodied radially between the guidance tube and the sheath;

wherein a longitudinal end of the sheath located closer to the inactive position is secured, detachably, on at least one of the guidance apparatus and the coupling arrangement; wherein the guidance tube comprises, at its longitudinal end located closer to the active position, openings passing radially through the guidance tube; and wherein the openings connect the displacement volume with the gas-conveying conduit formed between the sheath and the guidance tube.

2. The magnetic isolating apparatus according to claim 1, wherein a longitudinal end of the sheath located closer to the active position of the magnet arrangement, constituting an immersion longitudinal end, forms the immersion portion of the isolation apparatus.

3. The magnetic isolating apparatus according to claim 1, wherein a longitudinal end of the sheath located closer to the inactive position is secured on at least one of the guidance apparatus and the coupling arrangement;

further comprising a sheath that surrounds the magnet arrangement orthogonally to the guidance path radially externally at least in the active position, and along the guidance path on the side facing away from the inactive position.

4. The magnetic isolating apparatus according to claim 1, further comprising a piston, connected to the magnet arrangement for motion together, which carries the sealing arrangement, the magnet arrangement being connected to the piston on a side thereof facing toward the displacement volume or at a region thereof located in the displacement volume.

5. The magnetic isolating apparatus according to claim 4, wherein a piston rod that connects the piston and the magnet arrangement for motion together is arranged between the piston and the magnet arrangement.

6. The magnetic isolating apparatus according to claim 5, wherein the guidance apparatus directly guides the piston and the piston rod to move along the guidance path.

7. The magnetic isolating apparatus according to claim 4, wherein the guidance apparatus comprises a guidance tube, the magnet arrangement being located, in any operating position, axially outside the guidance tube with reference to the tube axis of the guidance tube.

8. The magnetic isolating apparatus according to claim 1, wherein the coupling arrangement comprises a connecting conduit that fluid- and pressure-transferringly connects the apparatus coupling point to an actuation volume.

9. The magnetic isolating apparatus according to claim 1, wherein a holding apparatus comprising a holding magnet or a soft-magnetic holding component, which holds the magnet apparatus in the inactive position, is provided in the region of the inactive position.

10. The magnetic isolating apparatus according to claim 1, further comprising a control magnet arrangement whose magnetic field in the region of the guidance path is modifiable.

11. The magnetic isolating apparatus according to claim 10, wherein the control magnet arrangement encompasses a switchable electromagnet.

12. The magnetic isolating apparatus according to claim 10, further comprising a base body that is coupled to the guidance apparatus.

13. The magnetic isolating apparatus according to claim 12, wherein the control magnet arrangement is provided on the base body.

14. The magnetic isolating apparatus according to claim 12, wherein the base body includes a coupling arrangement that is coupled at a first coupling point, constituting a guidance coupling point, to the guidance apparatus, and is embodied at a second coupling point, different from the first coupling point and constituting an apparatus coupling point, for detachable coupling to a pipetting channel of a pipetting apparatus.

15. The magnetic isolating apparatus according to claim 10, further comprising at least one of a container embodied for reception of the suspension and a container carrier embodied for reception of the container, the control magnet arrangement being provided on the at least one of the container and on the container carrier.

16. The magnetic isolating apparatus according to claim 15, further comprising the container carrier that comprises a receiving recess for reception of a container portion, the control magnet arrangement being provided at at least one location of on the container carrier so as to surround the receiving recess, and below a placement surface on which the container, received on the container carrier, stands as intended on the container carrier.

17. The magnetic isolating apparatus according to claim 1, wherein the drive apparatus encompasses a pipetting apparatus.

18. The magnetic isolating apparatus according to claim 1 wherein a longitudinal end of the sheath located closer to the inactive position is secured, detachably, on at least one of the guidance apparatus and the coupling arrangement;

further comprising a sheath that surrounds the magnet arrangement orthogonally to the guidance path radially externally at least in the active position, and along the guidance path on the side facing away from the inactive position.

19. The magnetic isolating apparatus according to claim 1, wherein the gas-conveying conduit is embodied radially between the coupling arrangement and the sheath.

* * * * *